US007228831B1

(12) United States Patent
O'Gorman et al.

(10) Patent No.: US 7,228,831 B1
(45) Date of Patent: Jun. 12, 2007

(54) CAMSHAFT AND OIL-CONTROLLED CAMSHAFT PHASER FOR AUTOMOTIVE ENGINE

(75) Inventors: Ryan O'Gorman, Berkley, MI (US); Jonathan Edward Fleming, Canton, MI (US); Joel John Beltramo, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 27 days.

(21) Appl. No.: 11/306,018

(22) Filed: Dec. 14, 2005

(51) Int. Cl.
*F01L 1/34* (2006.01)

(52) U.S. Cl. ..... 123/90.17; 123/90.15; 123/90.6; 29/888.1; 464/160

(58) Field of Classification Search ..... 123/90.15, 123/90.16, 90.17, 90.18, 90.27, 90.31, 90.6; 464/1, 2, 160; 29/888.1
See application file for complete search history.

(56) References Cited

U.S. PATENT DOCUMENTS 5,138,985 A 8/1992 Szodfridt et al.
5,540,197 A 7/1996 Golovatai-Schmidt et al.
5,566,651 A 10/1996 Strauss et al.
5,794,578 A 8/1998 Strauss et al.
6,014,952 A 1/2000 Sato et al.
6,026,772 A 2/2000 Shirabe
6,675,752 B1 * 1/2004 Kunne et al. ..... 123/90.17

FOREIGN PATENT DOCUMENTS

| | | |
|---|---|---|
| DE | 4024057 | 9/1991 |
| EP | 0469332 | 2/1992 |
| JP | 4232316 | 8/1992 |
| JP | 8232616 | 9/1996 |
| JP | 11153009 | 6/1999 |
| JP | 11182213 | 7/1999 |
| WO | WO9324736 | 12/1993 |

* cited by examiner

*Primary Examiner*—Ching Chang
(74) *Attorney, Agent, or Firm*—Gary A. Smith; Artz & Artz, P.C.

(57) ABSTRACT

An adjustable camshaft system for an automotive engine includes a camshaft having machined and fabricated axially-directed control passages combined with an oil-activated camshaft phaser. The fabricated oil control passages are formed within a portion of the camshaft having an outside diameter which is substantially equal to the outside diameter of other portions of the camshaft fitted within bearings carried within the engine's cylinder head.

12 Claims, 2 Drawing Sheets

CAMSHAFT AND OIL-CONTROLLED CAMSHAFT PHASER FOR AUTOMOTIVE ENGINE

TECHNICAL FIELD

The present invention relates to a camshaft which is specially fabricated for use with an oil-controlled camshaft phaser capable of changing the timing relationship between the crankshaft and camshaft of a reciprocating internal combustion engine.

BACKGROUND

Oil-controlled camshaft phasers are known in the art. Such devices allow camshaft timing to be continuously adjusted by a closed loop control system. Usually, actuation is controlled by engine oil, which is ported to the phaser at a control pressure. The actual phase angle of the camshaft with respect to the crankshaft is determined by means of sensors which monitor both crankshaft and camshaft position in real time. Oil is caused to be directed by a control valve to either a retard port or an advance port of the phaser to achieve the necessary adjustment in camshaft position. It is known to run oil through camshaft itself to achieve adjustment. U.S. Pat. Nos. 5,138,985 and 6,026,772 disclose systems in which oil is run about the camshaft itself. Each of the systems of the '985 and '772 patents are characterized by very large camshaft diameters in the area in which the oil is furnished to the camshaft phaser. Also, these designs rely on passages which are machined into the interior of the camshaft, and this presents problems because axial drillings are difficult both to machine and to clean after the machining process. Unfortunately, the presence of foreign material may cause a camshaft phaser to fail.

The present system uses a sleeve and axially directed grooves machined through the surface and into a subdiametral portion of the camshaft. The grooves and sleeve, taken together make up axially directed oil control passages.

SUMMARY

An adjustable camshaft system for an automotive engine includes a camshaft mounted within a cylinder head upon a plurality of camshaft bearings, including a front bearing. The camshaft has a driven end extending from the front bearing. An oil-activated camshaft phaser is attached to the driven end of the camshaft. The phaser has at least one timing advance port and at least one timing retard port. A plurality of axially directed control passages, which are operably associated with the driven end of the camshaft, extend from the front camshaft bearing to the camshaft phaser. Each of these control passages includes an axially directed groove formed in a cylindrical surface of the driven end of the camshaft. The grooves are capped by a cylindrical sleeve applied to the driven end. A plurality of control ports formed in the cylindrical sleeve is in registry with the previously described axially directed grooves. The control ports themselves are in axial registry with a plurality of oil control passages extending radially through the front camshaft bearing. At least one exterior signal port is formed in the cylindrical sleeve and extends from one of the control passages. This exterior signal port is in axial registry with one of the phaser's timing advance port and the timing retard port. At least one interior signal port is formed within an inner annular wall of the camshaft and extends from one of the axially directed control passages. The interior signal port is in axial registry with an annular passage extending to one of the timing advance port and the timing retard port.

The compactness of the present unit is promoted by the fact that the cylindrical sleeve which forms one portion of the control passages within the camshaft has an outside diameter which approximates the outside diameter of other camshaft bearing surfaces formed on the camshaft.

Each of the axially directed grooves formed in the driven end of the camshaft has a generally rectilinear cross section. This means that the grooves are at least predominantly parallel-sided. This configuration results from the milling or grinding processes used to form the grooves in the camshaft.

According to another aspect of the present invention, a method for manufacturing an internal combustion engine camshaft for use with an oil-activated camshaft phaser includes the steps of machining a plurality of camshaft bearing surfaces to a common diameter, machining a front bearing portion of the camshaft to a diameter less than the common diameter, cutting a plurality of generally parallel-sided, axially-directed control passage grooves within the front bearing portion of the camshaft, and applying a ported sleeve, having an external camshaft bearing surface with a diameter proximate said common diameter, to the front bearing portion of the camshaft, thereby capping the grooves and forming a plurality of axially directed control passages within the camshaft.

It is an advantage of a camshaft and oil-controlled phaser according to the present invention that the fabricated front portion of the camshaft is of a sufficiently small diameter so as to reduce the package dimension, weight, and inertia of not only the camshaft, but also a phaser mounted upon the camshaft.

It is a further advantage of a camshaft and phaser system according to the present invention that fabricated passages in the camshaft permit excellent inspection and cleaning of the passages during manufacturing of the camshaft, thereby promoting reliability of the camshaft system once it is installed within an engine.

It is another advantage of the present invention that because the oil passages immediately underlie the surface of the camshaft, less pumping work is required to move control oil through the camshaft.

Other advantages, as well as features and objects of the present invention will become apparent to the reader of the specification.

DETAILED DESCRIPTION OF THE PREFERRED EMBODIMENTS

Figure 1:
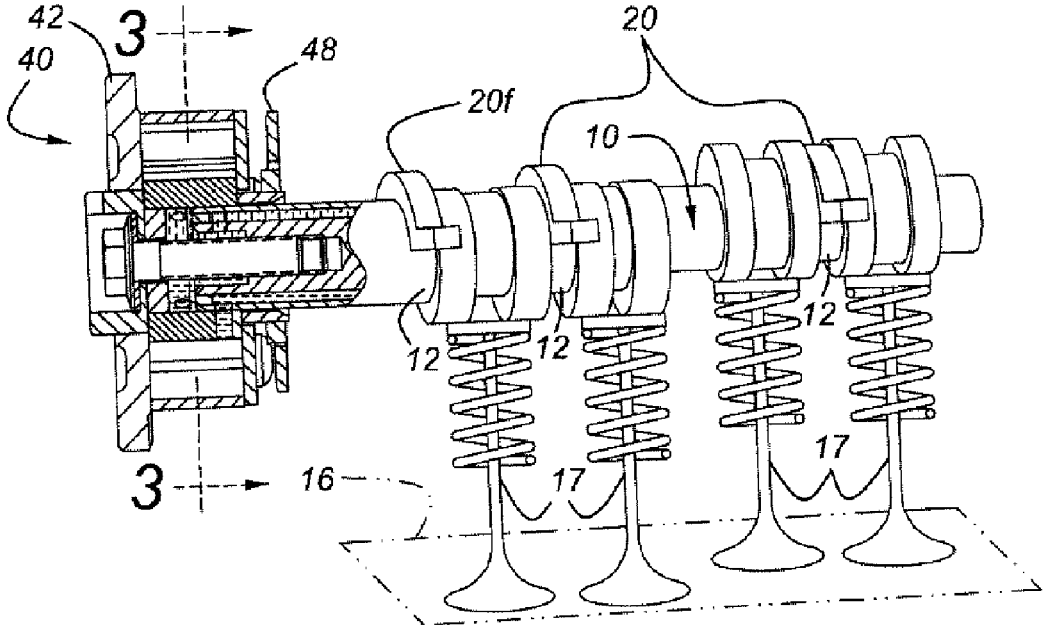
FIG. 1 is a perspective view of a camshaft and phaser system according to the present invention.

As shown in FIG. 1, camshaft 10 has a number of camshaft bearing surfaces, 12, which allow camshaft 10 to be mounted to cylinder head 16 by means of camshaft bearings 20. Camshaft 10 operates a number of poppet valves, 17, which control the gasses flowing into and out of the cylinders of an engine. Camshaft journals 20 are mounted on camshaft saddles 20*g*, (FIG. 2) by means of a plurality of bearing caps 20*f* (one shown). Camshaft position identification wheel 48 is locked to camshaft 10.

FIG. 1 also shows oil-activated camshaft phaser 40, which has a drive sprocket, 42, for connection with the engine's crankshaft by means of a timing chain (not shown).

Figure 2:
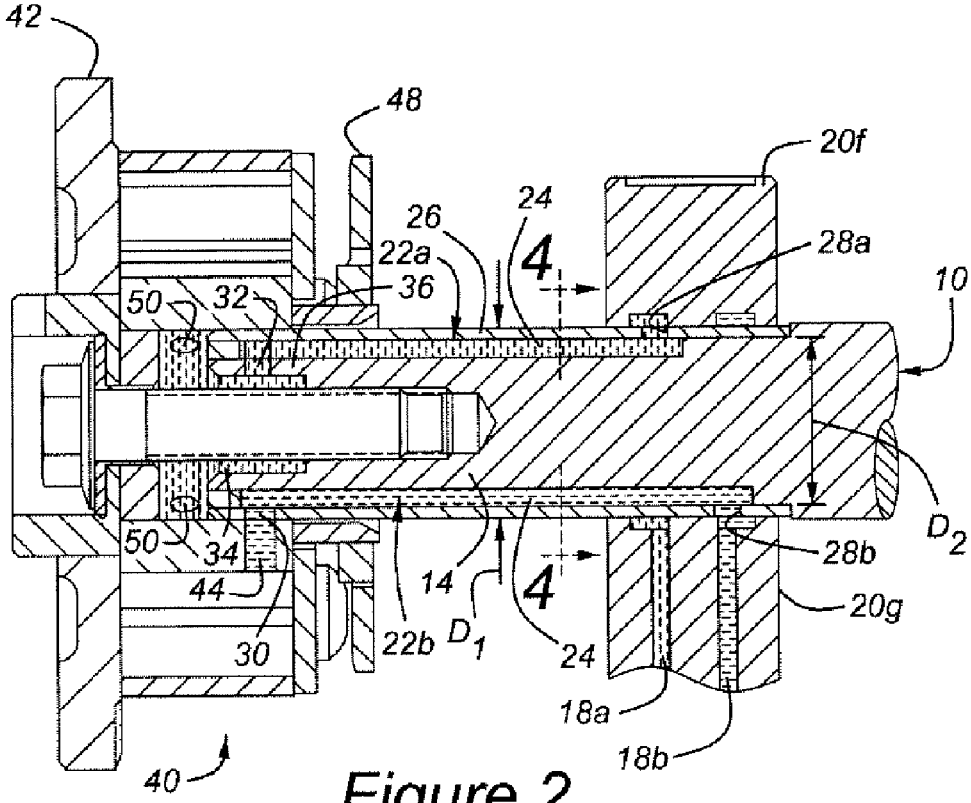
FIG. 2 is a sectional view of a phaser and camshaft according to the present invention.
Figure 3:
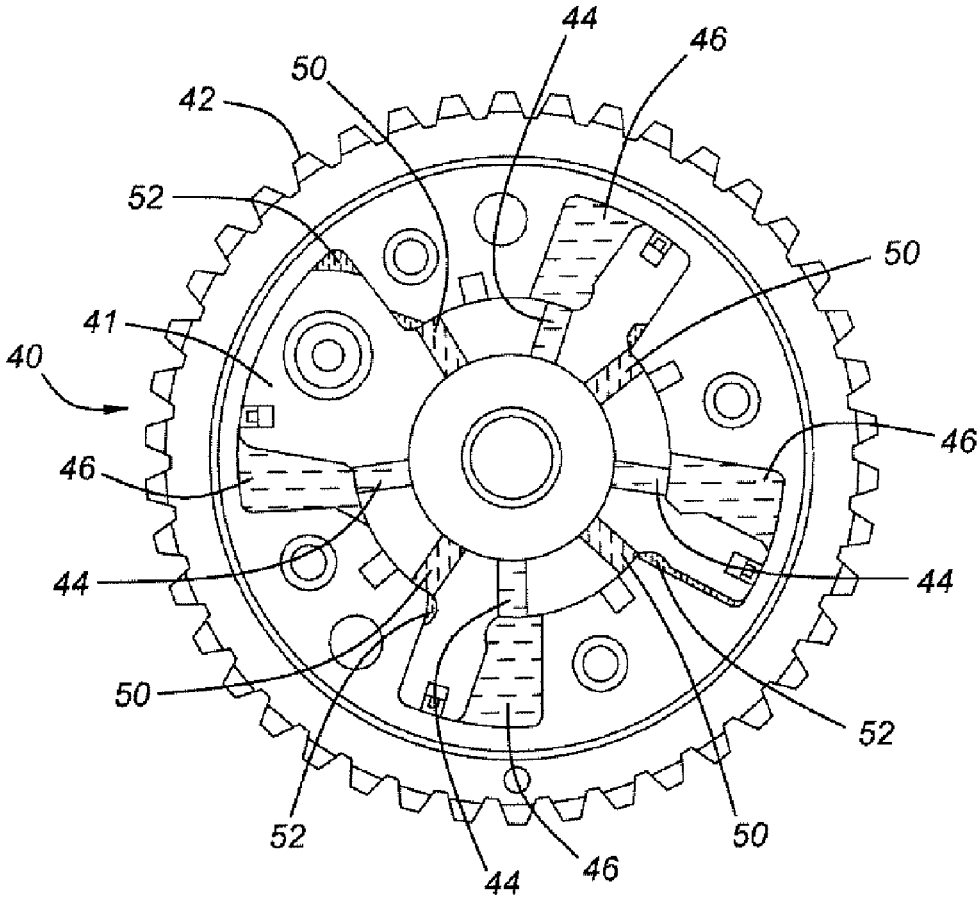
FIG. 3 is a plan view cutaway of a phaser according to the present invention taken along the line 3-3 of FIG. 1.

Moving now to FIG. 2, camshaft 10 is shown as having at least two control passages, 22, which are axially directed and formed in the front, or driven, end, 14, of camshaft 10. Driven end 14 is said to be subdiametral because diameter $D_2$, which is the diameter to which driven end 14 is reduced during machining of the camshaft, has a lesser dimension, and in fact, is smaller than diameter $D_1$. This latter diameter, $D_1$, characterizes both the diameter of the parent camshaft through the remaining cam bearings of the engine, as well as the outside diameter of cylindrical sleeve 26, which will be discussed in further detail below.

FIG. 2 shows the manner in which sleeve 26 cooperates with a plurality of axially directed grooves, 24, to form oil control passages 22. Control passages 22 extend from cam bearing cap 20*f* and saddle 20*g* into camshaft phaser 40. As shown in FIG. 2, control port 28*a* formed in sleeve 26 is a retard control port. Port 28*a* picks up an oil pressure signal from oil control passage 18*a* and allows oil to flow through connected control passage 22*a* to interior signal port 32. Control port 28*b*, an advance control port formed within sleeve 26, picks up an oil pressure signal from oil control passage 18*b* formed in camshaft bearing saddle 20*g* and transmits the signal through control passage 22*b*.

Oil flowing through control port 28*b*, the advance control port, flows forward an associated passage 22 and leaves such passage 22 through exterior signal port 30. Upon leaving exterior port 30, the oil enters oil activated phaser 40 through timing advance ports 44. The control oil then flows from timing advance ports 44 into a plurality of timing advance chambers 46. Timing advance chambers 46 cause rotor 41 to move in a direction tending to advance the timing of camshaft 10 with respect to the engine's crankshaft. If, however, oil flows through interior signal port 32 which is formed in inner annular wall 36 of camshaft 10, the oil will then flow through annular passage 34 and into timing retard ports 50 of camshaft phaser 40. Timing retard chambers 52 within phaser 40 are connected with timing retard ports 50, and oil pressure applied within timing retard ports 52 will cause rotor 41 to move in a direction tending to retard camshaft 10 with respect to the engine's crankshaft.

Figure 4:
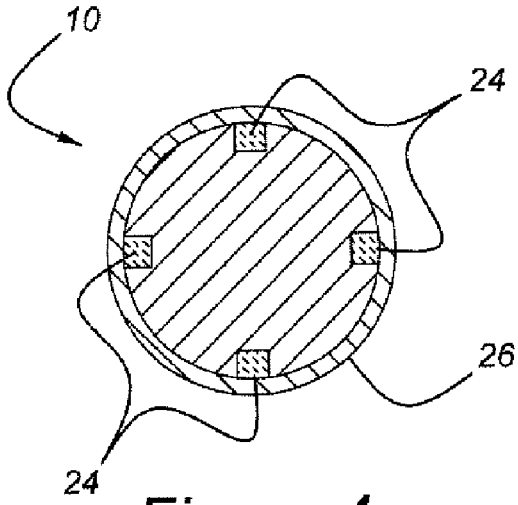
FIG. 4 is an end view of the driven end of a camshaft according to the present invention taken along the line 4-4 of FIG. 2.

FIG. 4 shows clearly that axially directed grooves 24 have parallel sides resulting from the machining of the grooves themselves. Those skilled in the art will appreciate in view of this disclosure that grooves 24 could be formed by any one of a number of machining processes, used either singly, or in combination with others. For example, grooves 24 could be made by milling, grinding, or other processes. The generally parallel sides allow for excellent inspection and cleaning of grooves 24 during the manufacturing process.

From the foregoing it is thus seen that sleeve 26 functions not only as an integral part of control passages 22, but also as a bearing surface for camshaft 10. This allows one wishing to employ the present invention to discard the need for axial drillings of the camshaft, which as explained above, are fraught with expense and manufacturing problems.

While particular embodiments of the invention have been shown and described, numerous variations and alternate embodiments will occur to those skilled in the art. Accordingly, it is intended that the invention be limited only in terms of the appended claims.

What is claimed is:

1. An adjustable camshaft system for an automotive engine, comprising:

a camshaft mounted within a cylinder head upon a plurality of camshaft bearings, including a front bearing, and with said camshaft having a driven end extending from said front bearing;

an oil-activated camshaft phaser attached to the driven end of the camshaft, with said phaser having at least one timing advance port and at least one timing retard port;

a plurality of axially directed control passages operatively associated with said driven end of said camshaft and extending from said front camshaft bearing to said camshaft phaser, with each of said control passages comprising an axially directed groove formed in a cylindrical surface of the driven end of the camshaft, and with said grooves being capped by a cylindrical sleeve applied to said driven end;

a plurality of control ports formed in said cylindrical sleeve in registry with said axially directed grooves, with said control ports being in axial registry with a plurality of oil control passages extending radially through the front camshaft bearing;

at least one exterior signal port formed in said cylindrical sleeve and extending from one of said control passages, with said exterior signal port being in axial registry with one of said timing advance port and said timing retard port; and at least one interior signal port formed within an inner annular wall of said camshaft and extending from one of said control passages, with said interior signal port being in axial registry with an annular passage extending to one of said timing advance port and said timing retard port.

2. An adjustable camshaft system according to claim 1, wherein said axially directed grooves of said control passages are formed in a sub-diametral portion of said camshaft.

3. An adjustable camshaft according to claim 1, wherein said cylindrical sleeve has an outer diameter proximate the inside diameter of said camshaft bearings.

4. An adjustable camshaft system according to claim 1, wherein said exterior signal port is in fluid communication with the phaser advance port.

5. An adjustable camshaft system according to claim 1, wherein said interior signal port is in fluid communication with the phaser retard port.

6. An adjustable camshaft system according to claim 1, wherein said phaser comprises a plurality of rotor-mounted vanes located within control chambers, with said control chambers being operatively connected with said timing advance port and said timing retard port.

7. An adjustable camshaft system according to claim 1, wherein each of said axially directed grooves formed in the driven end of the camshaft has a rectilinear cross section.

8. An adjustable camshaft system according to claim 1, wherein each of said axially directed grooves formed in the driven end of the camshaft is at least predominantly parallel-sided.

9. A camshaft for an automotive engine, comprising:

a shaft having a driven end and a plurality of valve operating lobes;

a plurality of cylindrical bearing surfaces formed on said shaft, with said bearing surfaces having a common bearing diameter;

a ported concentric sleeve applied to a sub-diametral portion of said driven end of said camshaft, with said sleeve having an outer diameter proximate said common bearing diameter; and a plurality of axially directed control passages, with each of said control passages having an outer wall defined by a different portion of said sleeve, and with each of said control passages extending from a bearing surface of the sleeve to a mounting location for an oil-activated camshaft phaser.

10. A camshaft according to claim 9, wherein said control passages comprise a first plurality of passages for advancing the timing of the camshaft and a second plurality of passages for retarding the timing of the camshaft.

11. A camshaft according to claim 9, wherein said control passages comprise a first plurality of passages for communicating with a timing advance port of a camshaft phaser, and a second plurality of passages for communicating with a timing retard port of a camshaft phaser.

12. A method for manufacturing an internal combustion engine camshaft for use with an oil-activated camshaft phaser, comprising the steps of:

machining a plurality of camshaft bearing surfaces to a common diameter;

machining a front bearing portion of the camshaft to a diameter less than said common diameter;

cutting a plurality of generally parallel-sided, axially directed control passage grooves within said front bearing portion of the camshaft; and applying a ported sleeve, having an external camshaft bearing surface with a diameter proximate said common diameter, to said front bearing portion of the camshaft, thereby capping said grooves and forming a plurality of axially directed control passages within the camshaft.

* * * * *